US005490830A

United States Patent [19]

Lovelady et al.

[11] Patent Number: 5,490,830

[45] Date of Patent: Feb. 13, 1996

[54] AIR-COOLED BIOHAZARD CENTRIFUGE

[75] Inventors: Charles Lovelady, Irving; Bert R. Williams, III, DeSoto, both of Tex.

[73] Assignee: Global Focus Marketing & Distribution, Irving, Tex.

[21] Appl. No.: 225,990

[22] Filed: Apr. 12, 1994

[51] Int. Cl.[6] ..... B04B 5/02; B04B 7/02; B04B 15/02

[52] U.S. Cl. ..... 494/14; 494/20; 494/60

[58] Field of Search ..... 494/13, 14, 16, 494/20, 26, 60; 210/180, 186

[56] References Cited

U.S. PATENT DOCUMENTS

| | | | |
|---|---|---|---|
| 1,263,439 | 4/1918 | Leitch | 494/26 |
| 1,700,186 | 1/1929 | Squire et al. | 494/26 X |
| 2,005,094 | 6/1935 | Lindgren | 494/14 |
| 2,699,289 | 1/1955 | Allen et al. . | |
| 2,783,938 | 3/1957 | Grela et al. | 494/14 |
| 2,878,992 | 3/1959 | Pickels et al. | 494/14 |
| 2,917,229 | 12/1959 | Benedetto et al. | 494/14 |
| 3,148,146 | 9/1964 | Asnes et al. | 494/14 X |
| 3,804,324 | 4/1974 | Sinn et al. | 494/14 |
| 3,860,166 | 1/1975 | Anderson | 494/13 |
| 4,053,104 | 10/1977 | Penhasi et al. . | |
| 4,087,924 | 5/1978 | Fujimoro et al. | 494/26 X |
| 4,193,536 | 3/1980 | Kubota . | |
| 4,221,325 | 9/1980 | Kubota . | |
| 4,342,419 | 8/1982 | Conway . | |
| 4,531,652 | 7/1985 | Hara . | |
| 4,585,433 | 4/1986 | Cole . | |

FOREIGN PATENT DOCUMENTS

| | | | |
|---|---|---|---|
| 1029299 | 4/1958 | Germany | 494/13 |
| 1034550 | 7/1958 | Germany | 494/14 |
| 2611679 | 9/1977 | Germany | 494/14 |
| 4014439 | 7/1991 | Germany | 494/14 |
| 54-117975 | 9/1979 | Japan | 494/14 |

*Primary Examiner*—David Scherbel
*Assistant Examiner*—Charles E. Cooley
*Attorney, Agent, or Firm*—Fulwider Patton Lee & Utecht

[57] ABSTRACT

A biohazard centrifuge having an improved air cooling arrangement, wherein a cooling air stream is directed onto and around the rotor chamber of the centrifuge without introducing cooling air thereinto. This results in cooling air being separated from the spinning rotor and reduces the possibility of contamination of the cooling air stream from a leaking sample container. Additionally, further protection to laboratory personnel is afforded by a sealed rotor assembly chamber, and by providing rotor assembly specimen containers or carriers having lids which are easily attached and removed, requiring a simple partial twist to lock the lids into place.

19 Claims, 4 Drawing Sheets

AIR-COOLED BIOHAZARD CENTRIFUGE

BACKGROUND OF THE INVENTION

1. Field of the Invention

The present invention relates generally to centrifugal separation equipment employing an air cooling system to maintain the temperature of specimens being separated at approximately room temperature during centrifugation, and, more particularly, to such equipment adapted for use with hazardous materials.

2. Description of the Prior Art

Centrifuges are primarily used to separate relatively solid particles, such as blood cells, from fluids, and are generally employed in a laboratory environment. Typically, centrifuge equipment includes a rotor assembly positioned within a rotor chamber in a centrifuge housing. The housing usually includes a latchable lid or cover to allow access to the rotor for placement or removal of samples, and to enclose the rotor when centrifugation of specimens is occurring.

Because the rotor spins at high speeds within the rotor chamber, heat builds up due to induced air turbulence therein. This heat build-up is not desirable because it can effect the samples being separated, and can alter the results of diagnostic procedures involving the samples.

One solution to this problem has been to provide refrigerated centrifugal separation equipment, wherein evaporator coils of a refrigeration system are wrapped around the rotor chamber walls to remove heat from within the chamber. Typically, such refrigerated centrifuge equipment is more costly, and is prone to problems resulting from frost and condensation formation within the refrigerated rotor chamber.

Another approach is to maintain the interior of the rotor chamber at ambient room temperature by providing a stream of cooling air through the rotor chamber to remove heat therefrom. Typically, this is accomplished by providing holes in the cover of the rotor chamber and in some way using the spinning motion of the rotor to propel air into, through, and out of the rotor chamber. This method is a less expensive alternative to refrigeration, and is acceptable for many applications.

However, there are occasions when it is desirable to separate a sample of hazardous material, for example, infected blood, or other materials containing pathogens or other harmful agents. These materials, if introduced into the atmosphere of a laboratory containing the centrifuge, for example, would be potentially harmful to lab personnel or laboratory animals. It has been recognized that conventional air-cooled centrifuge designs may allow harmful materials to be introduced into the cooling air blowing through the rotor chamber, for example, from a defectively sealed sample container, or as a result of a sample container breaking during centrifugation. Since such a leak occurs from a rapidly spinning rotor assembly, the harmful material will likely be introduced into a cooling airstream as an aerosol, which allows the harmful material to travel a considerable distance, and to be drawn into the respiratory tracts of people and animals in the laboratory and beyond.

As a consequence, it has been recognized that containment of hazardous materials is a desirable attribute of air-cooled centrifuge equipment. One approach has been to provide a rotor assembly which contains separately sealed covered sample carriers for containing specimen containers.

Such covered carriers provide a barrier to the escape of contaminants over and above the specimen containers placed therein. However, such carriers provide additional work for lab personnel, as conventional devices involve screwing down locking screws to hold lids on such carriers, or twisting threaded lids on and off such carriers.

Moreover, even with such additional containment provisions, it has been noted that it is still possible for hazardous materials to be introduced into a cooling airstream, thereby contaminating the laboratory, if a carrier is improperly sealed by an operator, or is otherwise defective. Because of the relatively high volume of air which must be pushed through the rotor chamber to keep it at ambient temperature, even a small leak can introduce a contaminant or pathogen or other harmful agent over a large area, and some such dispersed hazardous materials may be detrimental even at very small airborne concentrations.

In light of the foregoing, it has been recognized that hazardous aerosol contaminants carried in centrifuge cooling air exhaust is a particularly troubling problem. Centrifugal separation equipment employing air cooling preferably will mitigate the above-described problems. The desirable attributes of a centrifuge of this type should include convenience of function for lab personnel who will be operating the equipment, as well as providing for the safety of people and laboratory animals who may be exposed to air which has been used to cool the centrifuge. The present invention addresses these concerns.

SUMMARY OF THE INVENTION

Briefly, and in general terms, the present invention provides an improved air-cooled biohazard containment centrifuge which separates a cooling air stream from the interior of the rotor chamber, providing a barrier between the cooling air and the interior of the rotor chamber, but providing for transfer of heat across the barrier to maintain the interior of the rotor chamber at approximately ambient room temperature. The centrifuge of the invention includes a housing defining the exterior of the centrifuge, having openings therein for admitting and exhausting air; a rotor assembly adapted to hold specimens to be processed, being carried by a drive motor shaft, the drive motor being supported by the housing; a rotor chamber housing defining a rotor chamber, supported by the centrifuge housing, adapted to contain the rotor assembly; and, a fan which draws air through an opening in the centrifuge housing, the air being exhausted through another opening in the centrifuge housing. The air flowing through the centrifuge housing is directed into the rotor chamber housing, removing excess heat therefrom. However, the rotor chamber housing provides a separating barrier preventing intermingling of cooling air with air inside the rotor chamber.

The centrifuge rotor assembly includes carriers or containers, which each incorporate a containment lid which easily is removed or attached by a twisting motion to contain the specimen samples within the spinning rotor assembly. This conveniently provides an additional barrier between the specimen being separated and the ambient air around the centrifuge.

Moreover, the centrifuge of the invention provides a sealed rotor chamber, and in a more detailed aspect, incorporates a translucent cover, allowing an operator to view the interior rotor of the chamber. This enables an operator to ascertain that the containment lids are closed and no leaks of hazardous material have occurred before opening the cover of the rotor chamber. Additionally, the covers which contain individual specimens within a container or carrier assembly of the rotor are formed of translucent material so that the samples inside can be observed before opening the containers. These features are advantageous as they reduce the possibility of hazardous material being released to the atmosphere of the laboratory.

Also, in a further more detailed aspect, the translucent biohazard containment lids of the individual containers or carriers incorporated in the rotor assembly are provided with a L-shaped slot which cooperates with a pin in the carriers or containers to provide a secure attachment of each translucent cover with a simple partial twist of the cover. This is advantageous as the containment cover can be quickly removed from, or placed on the sample carrier. The simple and quickly executable nature of the container cover attachment provides increased confidence that users will securely fasten the lid before each use. Also, the redundancy of the sealable rotor chamber separating the rotor assembly including specimen containers or carriers from the atmosphere gives rise to increased confidence that a leak of hazardous material will not compromise the atmosphere in the laboratory.

In another more detailed aspect, the centrifuge rotor chamber housing of the invention may be provided with fins or the like to increase the surface area of the rotor chamber housing and enhance heat transfer from the rotor chamber to the cooling air. Additionally, a serpentine pathway for cooling air may be provided to increase the time the cooling air is in contact with the rotor chamber housing to be cooled, to increase heat transfer therefrom. Also, an airflow path may be defined whereby electronic components of the centrifuge are cooled, as well as the rotor assembly drive motor.

In a further more detailed aspect,, an airflow may be provided by a cooling fan at an outlet opening of the centrifuge housing, to draw air out therefrom, thereby creating a vacuum within the centrifuge housing which draws air into an inlet opening. Alternatively, the fan can blow cooling air into the housing in a manner opposite that just described. In a further alternate construction, a fan may be provided on the centrifuge rotor drive shaft outside the rotor chamber housing to force air through an opening in the housing of the centrifuge and onto and around the centrifuge rotor chamber housing. In either case, it will be appreciated that a fan may blow air into the housing of the centrifuge or the fan may draw air therefrom to create a cooling air flow stream around the rotor containment housing.

In an additional more detailed aspect, a baffle plate can be provided to separate a lower portion of the centrifuge housing from an upper portion containing the rotor chamber housing, except for one or more openings for air to pass by the baffle plate at desired locations. Cooling air can be made to flow through the bottom portion of the centrifuge housing, cooling electronic components of the centrifuge as well as the rotor drive motor for example. Cooling air travels to the one or more openings defined by the baffle plate, through or around it, and then travels up and around the rotor housing and out through an exhaust vent opening in the upper portion of the centrifuge housing. As will be apparent to one skilled in the art, in addition to cooling fins around the rotor chamber housing, additional baffle plates could be provided to direct air to various parts of the rotor chamber housing as required for optimum cooling and heat transfer.

Other features and advantageous of the invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
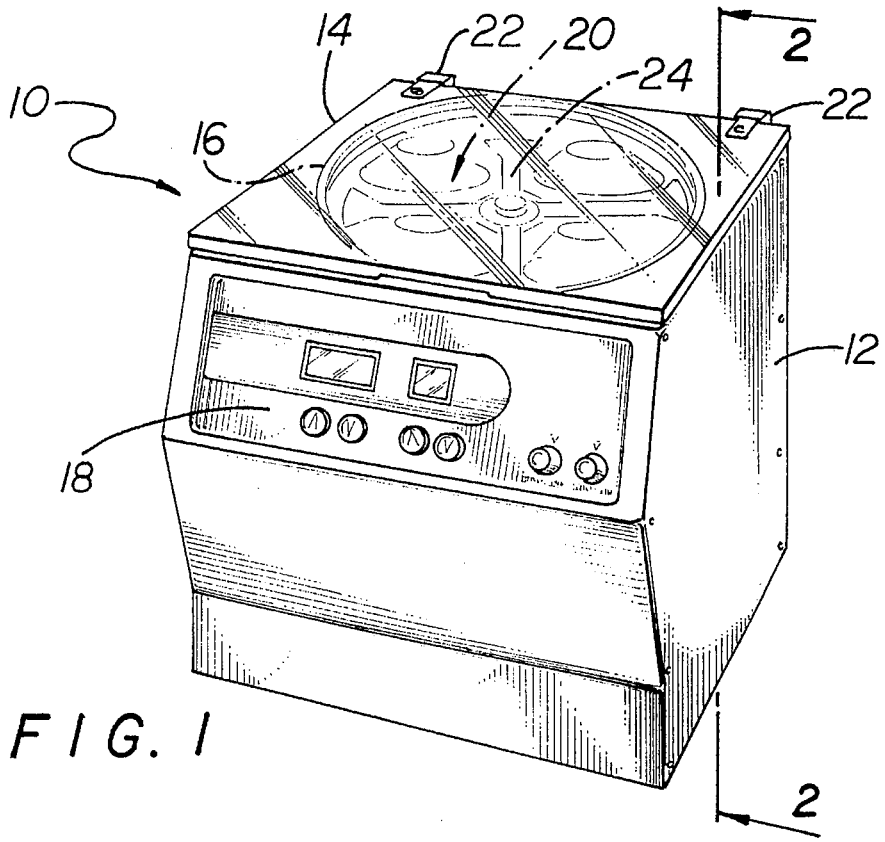
FIG. 1 is a perspective view of a centrifuge of the invention.

As shown in FIG. 1 of the drawings, which are provided for purposes of exemplary illustration, the invention is embodied in a biohazard centrifuge 10 having an housing 12 incorporating a hinged rotor chamber cover 14 which is formed of a high strength translucent material, such as LEXAN® a trademark of General Electric Corporation for polycarbonate resins for example. Also incorporated in the centrifuge housing is a seal 16 between the rotor chamber cover and the rest of the centrifuge housing. A control panel 18 is also incorporated in a front side of the centrifuge housing 12.

The interior of the rotor chamber 20 is accessible by lifting the rotor chamber cover 14, which rotates around hinges 22. An interlock mechanism (not shown) is provided as is known in the art to prevent the rotor chamber cover from being opened while the rotor 24 is in motion.

Figure 2:
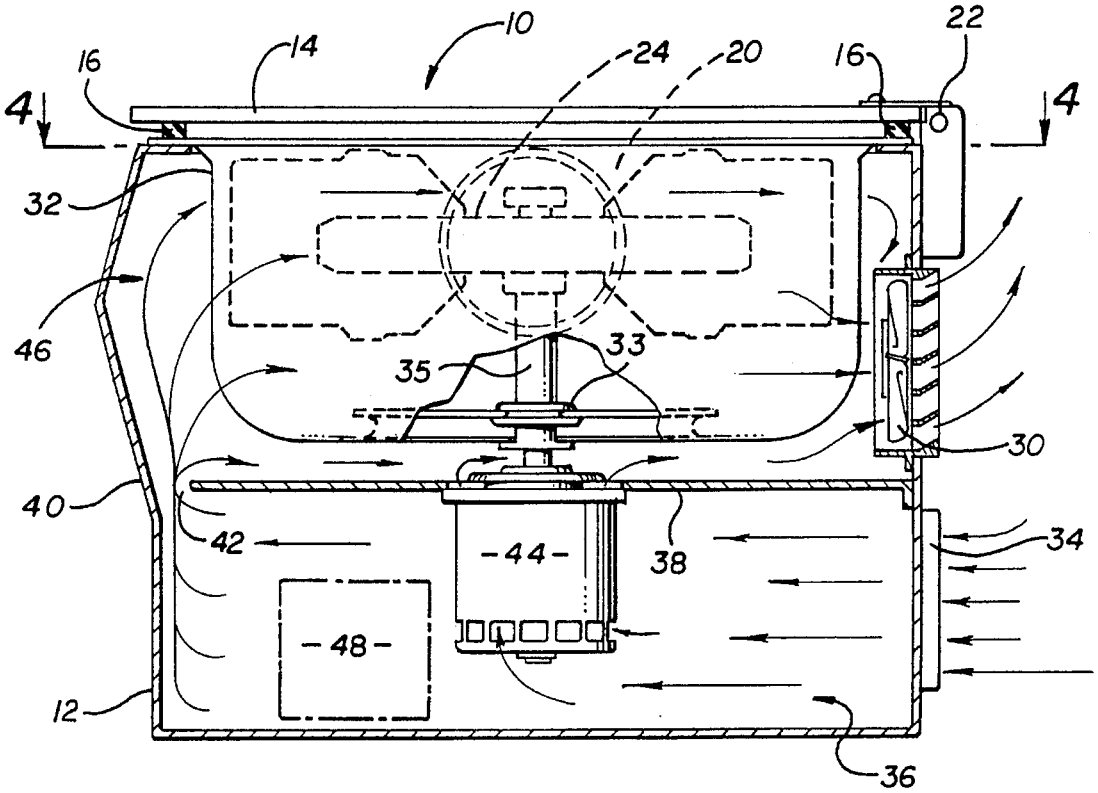
FIG. 2 is an elevational cross-section view of the centrifuge of the invention taken along line 2—2 in FIG. 1, schematically showing the flow of air therethrough.
Figure 3:
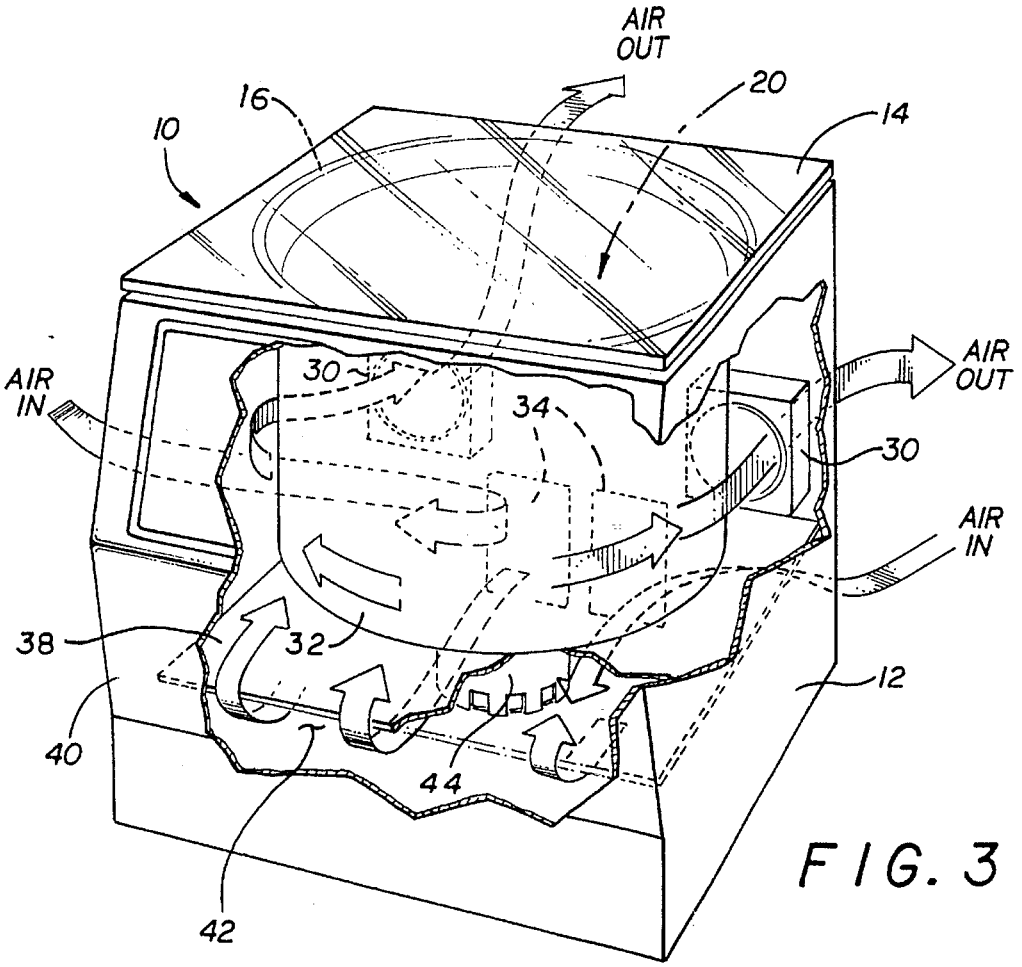
FIG. 3 is a perspective view of the centrifuge of the invention shown partially in cut-away, showing schematically the flow of air therethrough.

Referring now to FIGS. 2 and 3, the centrifuge 10 is cooled by a fan 30 drawing air through the centrifuge housing 12, the internal configuration providing for a cooling air flow onto and around the outside of a rotor chamber housing 32 enclosing the rotor chamber 20. A rotor assembly shaft seal 33 is provided in the bottom of the rotor chamber housing 32 to seal the chamber 20 around the drive shaft 35 of the rotor assembly 24. More particularly, fans 30 draw air through an inlet 34 into a lower portion 36 of the housing 12. This lower portion is separated from an upper portion 46 by a baffle plate 38 which mates with the walls of the centrifuge housing except for at a front wall 40. An opening 42 is left between the baffle plate and the front wall, forcing air drawn into the inlet 34 to pass through this relatively narrow opening extending the width of the housing 12 at the front of the centrifuge 10, before traveling around the rotor chamber housing 32 and back to the fans 30. As may be appreciated by one skilled in the art, the combination of the baffle plate and the narrow opening provides a turbulent air flow which is made to contact the rotor chamber housing from a front portion rearwardly to the back of the centrifuge housing 12 where the fans are located. This results in improved heat transfer from the rotor chamber to the cooling air.

Additionally, a rotor assembly drive motor 44 can be positioned in the baffle plate 38 so that cooling air is drawn through the motor into the upper portion 46 as well as around it in the lower portion 36 of the centrifuge housing and through the opening 42 at the front of the centrifuge 10. Additionally, control circuits, power supplies, and the like, comprising electronic components 48 shown schematically in FIG. 2, are cooled by the cooling air drawn through the centrifuge housing 12 by the cooling fans 30. The cooling configuration of the invention providing for improved removal of heat from heat sources within the centrifuge 10.

Figure 4:
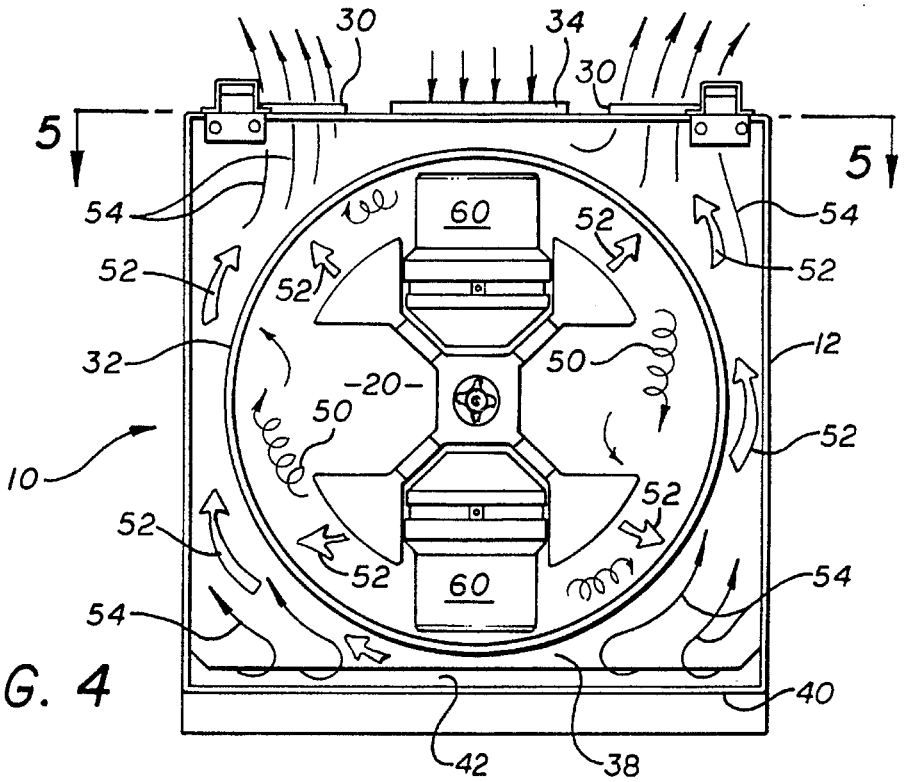
FIG. 4 is a cross-section view of the centrifuge of the invention taken along line 4—4 in FIG. 2, schematically showing air flow and heat transfer therein.
Figure 5:
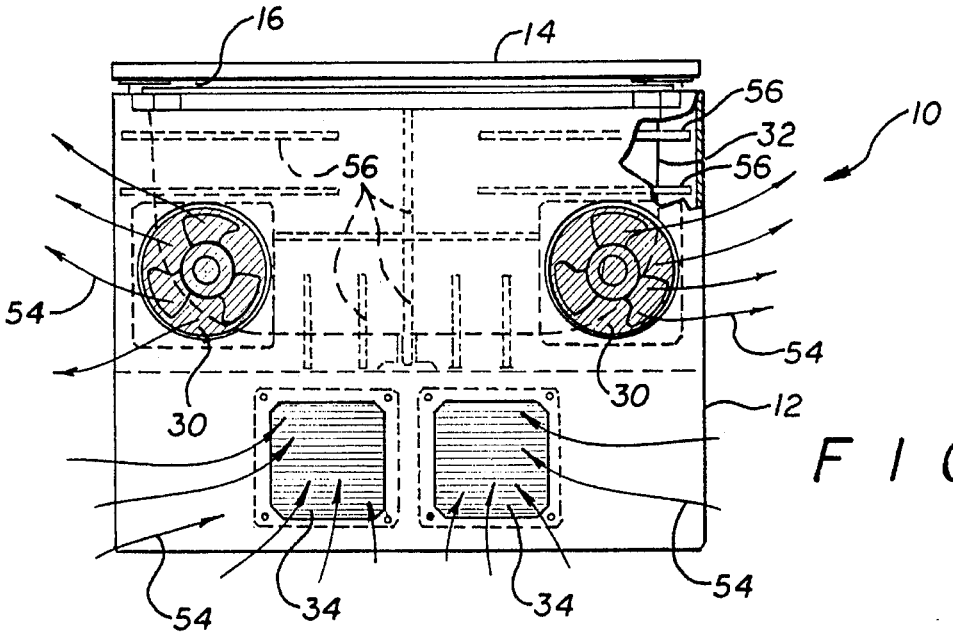
FIG. 5 is an elevational view, taken along line 5—5 in FIG. 4 of a rear portion of the centrifuge of the of the invention.

More particularly, referring to FIGS. 4 and 5, heat is removed from the rotor chamber 20 by the turbulent air 50 in the chamber 20 transferring heat 52 to the walls of the rotor chamber housing 32, and from the rotor chamber housing walls heat 52 is transferred to the cooling air stream 54.

As can be seen particularly in FIG. 5, the cooling air stream 54 is drawn in at inlets 34 below the baffle plate and exits the centrifuge 10 through fans 30 above the baffle plate. In order to increase heat transfer across the rotor chamber housing wall 32, fins 56 can be provided on the rotor chamber housing in contact with the cooling airstream 54 within the centrifuge housing 12.

As will be appreciated, centrifuge 10 of the invention is cooled to approximately ambient room temperature by means of the cooling air stream 54 which is separated from the interior of the rotor chamber 20. This minimizes the possibility that a contaminant in aerosol form, as is likely to be generated within the rotor chamber should a leak occur, will not be in contact with the cooling air stream. As a consequence, it is extremely unlikely that the lab environment will be contaminated by hazardous materials introduced into the cooling airstream 54 blowing through the biohazard centrifuge 10, even in the event of a sample leak within the rotor chamber 20.

Figure 6:
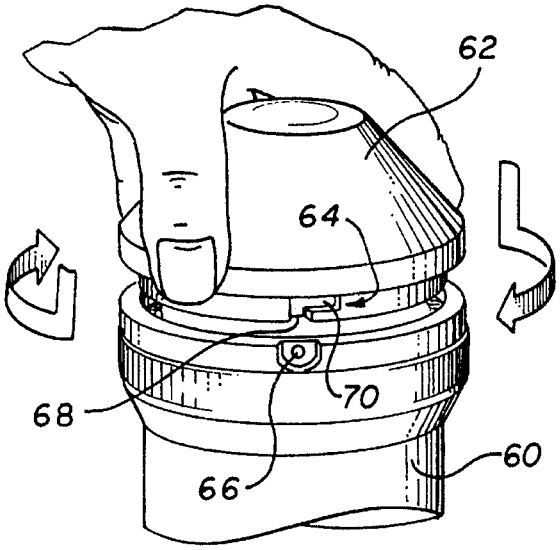
FIG. 6 is an perspective view of a biohazard containment lid and specimen carrier of a rotor assembly of the centrifuge of the invention, schematically showing attachment of the lid.
Figure 7:
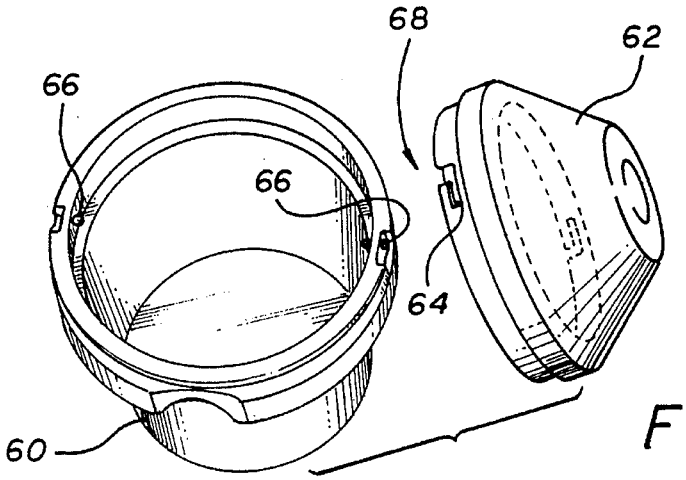
FIG. 7 is a perspective view of a sample carrier or container of and a biohazard containment lid of the invention.

Referring to FIGS. 6 and 7, to further ensure that hazardous materials being separated in the centrifuge 10 of the invention are safely contained, a conveniently closable sample container 60 is provided to act as a carrier for specimens (not shown) to be separated. The sample container interfits with the rotor 24 as is known in the art to provide an ability for the container to swing to a horizontal position in centrifugation of enclosed samples.

To provide a convenient closure, a translucent cover lid 62, formed of LEXAN® for example, is provided with a L-shaped slot 64. The sample container 60 is provided with a pin 66 which engages the L-shaped slot when closing the lid 62 over the sample container 60. As will be apparent, this arrangement effects a closure of the sample container by a simple twist of the lid 62, which locks into place by virtue of the pin 66 catching in the L-shaped slot. Also, as will be apparent, in addition the arrangement shown in FIGS. 6 and 7 employing two pins and two L-shaped slots, multiple pins around the circumference of the sample container 60 could be provided to cooperate with the same number of L-shaped slots provided in the lid 62, decreasing further the distance the lid must be turned before the pins align with slots 64, the lid then dropping into place, and further twisting effects closure.

A mouth portion 68 of the L-shaped slot 64 is made relatively wide to easily interfit with the pin 66. A horizontal portion 70 of the slot is given an slightly helical configuration so as to tightly engage the lid 62 and the sample container 60 as the lid is twisted in a clockwise direction when the pin 66 is engaged in the L-shaped slot 64. Disengagement of a lid is similarly simple, as the user needs only to twist the lid 62 in a counter clockwise direction a short distance and remove the lid, letting the pin 66 pass through the mouth portion 66 of the slot 64.

Figure 8:
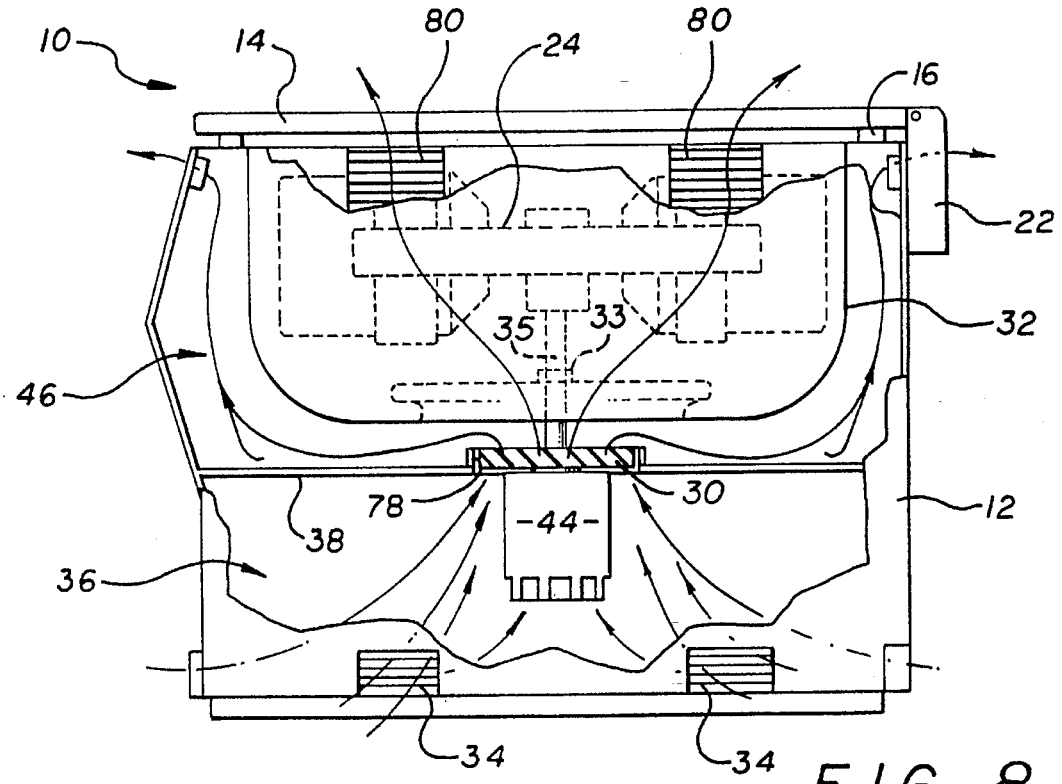
FIG. 8 is an elevational view, partially in cutaway, of an alternate embodiment of the centrifuge of the invention, schematically showing the flow of air therethrough.
Figure 9:
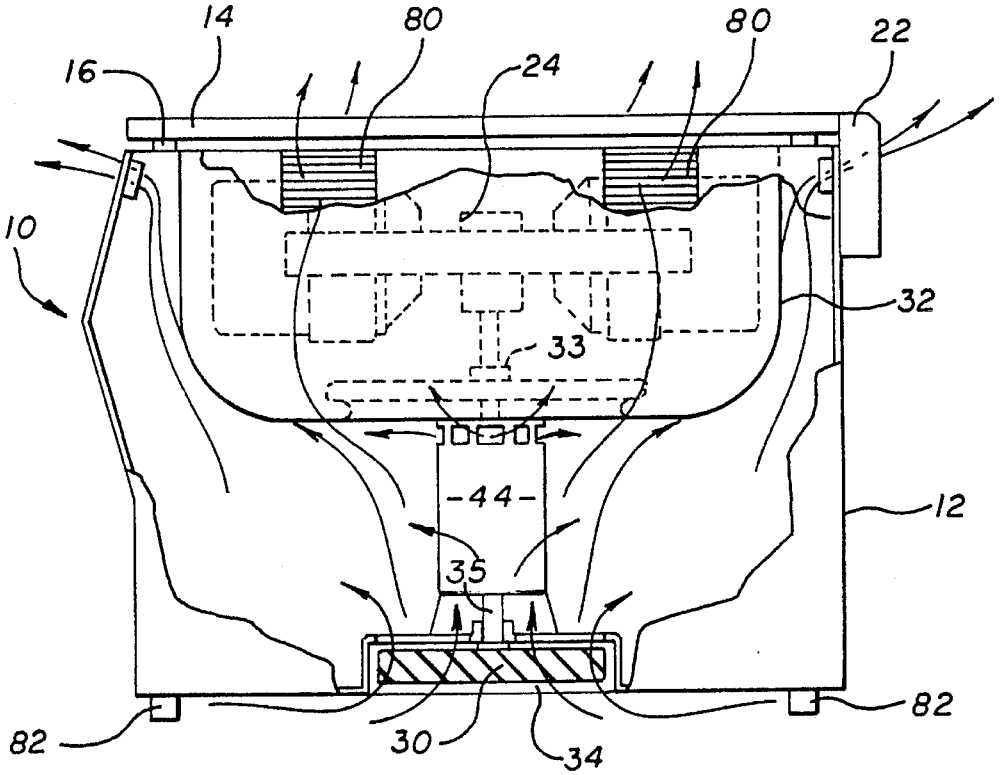
FIG. 9 is an elevational view, partially in cutaway, of a further alternate embodiment of the centrifuge of the invention, schematically showing the flow of air therethrough.

Turning to FIGS. 8 and 9, alternate embodiments of the centrifuge 10 according to the invention are illustrated. As will be appreciated by one skilled in the art, a cooling fan 30 could be provided on the shaft 35 of the drive motor 44 to provide a cooling air flow. In FIG. 8, a cooling air flow is provided by placing the fan in an opening 78 in the baffle plate 38 between the lower portion 36 and the upper portion 46 of the centrifuge housing. Cooling air is drawn through intake vents 34 distributed about a lower outer periphery of the housing 12, through the lower portion 36 of the centrifuge housing, and forced by the fan into the upper portion 46 of the housing and onto the exterior of rotor chamber housing 32, traveling radially outward along a bottom portion of the rotor chamber housing between the rotor chamber housing and the baffle plate, and thereafter turning upward about the outer periphery of the rotor chamber housing and traveling up the sides thereof and exhausting through cooling air exhaust vents 80 disposed around an upper periphery of the centrifuge housing in the upper portion 46 thereof.

Alternatively, FIG. 9 illustrates a centrifuge 10 of the invention operating upon the same principle, but wherein the fan 30 is disposed on the shaft 35 of the drive motor 44 below the drive motor adjacent an inlet opening 34 in the centrifuge housing 12 at a bottom portion thereof. Cooling air is drawn from below the centrifuge housing, which it will be appreciated must be separated from a surface (not shown) on which it rests by spacing feet 82 to provide a air flow clearance underneath the centrifuge 10. Air drawn into the centrifuge housing 12 by the fan thus disposed on the shaft of the drive motor is blown upwardly to contact the bottom of the rotor chamber housing 32 and thereafter continues in a radial direction outward and around the outer periphery of the rotor chamber housing, and up and through exhaust vents 80 provided around an upper periphery of the centrifuge housing 12. As with the other embodiments described, a seal 16 is provided between a rotor chamber cover 14 and the rest of the centrifuge housing 12 to prevent co-mingling of cooling air and air within the rotor chamber 20.

From the foregoing, it will be appreciated that the centrifuge 10 of the invention allows hazardous materials to be separated with improved safety to laboratory personnel by providing a cooling airstream which is physically separated from the rotor chamber 20 and thereby avoids contact with any hazardous materials that may escape from within the rotor assembly 24 in motion. Also, an additional safety feature is provided in the more convenient provision of closed sample containers 60, 62 in the rotor assembly 24 to contain any hazardous material that may leak from samples contained within the container 60, and therefore is more likely to be used by laboratory personnel.

While several particular forms of the invention have been illustrated and described, it will also be apparent that various modifications can be made without departing from the spirit and scope of the invention. It is intended that the invention not be limited except by the appended claims.

What is claimed is:

1. A centrifuge adapted for use with hazardous materials, comprising:

an outer centrifuge housing defining an exterior surface of the centrifuge and an interior space therein, further comprising openings in the outer centrifuge housing adapted for admitting air and exhausting air;

an inner rotor chamber housing defining a sealable rotor chamber supported by the outer centrifuge housing, the rotor chamber being sealed to prevent movement of air between the rotor chamber and the interior space within said outer centrifuge housing;

a baffle having first and second sides incorporated within said outer centrifuge housing and separating the interior space of the outer centrifuge housing into a first portion and a second portion, said first and second portions interconnected by at least one opening in said baffle at a location where air is to flow between said first portion and said second portion from a first side of said baffle to a second side of said baffle, said air flowing from said first side to said second side of said baffle being directed onto and around said inner rotor chamber housing;

a rotor assembly adapted to hold specimens for centrifugation disposed within said sealable rotor chamber and carried by a rotor drive shaft which is actuated by a drive motor assembly incorporated in said centrifuge adapted for use with hazardous materials, said rotor drive shaft rotatably sealingly extending into said sealable rotor chamber; and at least one fan, incorporated in said centrifuge adapted for use with hazardous materials which blows the air through at least one of said openings in the outer housing, wherein the at least one fan, outer centrifuge housing, baffle and inner rotor chamber housing cooperate to direct cooling air caused to move into and out of said outer centrifuge housing by said at least one fan onto and around the inner rotor chamber housing increasing contact of said air with said inner rotor chamber housing to remove heat therefrom, the inner rotor chamber housing providing a seal preventing the air directed through the outer centrifuge housing onto the inner rotor chamber housing from coming into contact with air from within the inner rotor chamber housing.

2. The centrifuge of claim 1 wherein said baffle separates the interior space of the centrifuge defined by the outer centrifuge housing into an upper portion and a lower portion, and at least one of said openings in the outer housing is in communication with said lower portion and admits the air and at least one of said openings in the outer housing is in communication with said upper portion and exhausts the air therefrom, the inner rotor chamber housing being contained within said upper portion.

3. The centrifuge of claim 2 wherein the at least one fan is disposed to move the air from said lower portion to said upper portion of the interior space of the outer centrifuge housing through said at least one of said openings in said baffle.

4. The centrifuge of claim 3 having an electronic component disposed within said outer centrifuge housing wherein the air drawn through the outer centrifuge housing to cool the inner rotor chamber housing also intercepts and cools said drive motor assembly and said electronic component.

5. The centrifuge of claim 4 further comprising a rotor chamber lid and a rotor chamber lid seal, allowing selective sealing closure of the rotor chamber.

6. The centrifuge of claim 5 wherein the rotor chamber lid incorporates translucent material allowing the interior of the rotor chamber to be viewed with the lid closed.

7. The centrifuge of claim 5 further comprising specimen carrier containers incorporated in the rotor assembly having containment lids allowing the carrier containers to be closed to prevent escape of material therein, which carrier containers can be closed by twisting the lids less than one revolution after bringing the lids and containers into contact.

8. The centrifuge of claim 7 wherein the containment lids are formed of a translucent material enabling the interior of the specimen carrier containers to be viewed while the lids are on.

9. The centrifuge of claim 1, further comprising fins carried by said inner rotor chamber housing and in contact with said air directed onto and around said inner rotor chamber housing within said outer centrifuge housing, increasing the surface area of said inner rotor chamber housing and enhancing heat transfer from said rotor chamber to said air directed onto said rotor chamber housing.

10. A centrifuge adapted to centrifugation of hazardous materials, comprising:

an outer centrifuge housing comprising portions defining a front, back, top, bottom and two sides and an interior space therein, the front incorporating a control panel containing controls, and the top incorporating an opening into a rotor chamber, said outer centrifuge housing also incorporating a rotor chamber lid and a seal, said rotor chamber lid selectively sealingly closing the opening into said rotor chamber from the top of the outer housing;

a baffle plate within the outer centrifuge housing separating the interior space of the outer housing into an upper portion and a lower portion, said baffle plate being carried by said outer centrifuge housing and said baffle plate defining an opening between said upper and lower portions within the outer centrifuge housing at the front of the outer centrifuge housing;

a drive motor, supported by said baffle plate, for actuating a rotor assembly drive shaft and a rotor assembly;

said rotor chamber defined by an inner rotor chamber housing, said shaft having a shaft seal, the rotor chamber being isolated from the rest of the interior space of the outer centrifuge housing;

said rotor assembly adapted to hold hazardous material specimens, said rotor assembly having a specimen carrier incorporating a containment lid thereon having an L-shaped slot interfitting with a pin on the specimen carrier for engagement by less than a full turn of the lid with respect to the specimen carrier, the rotor assembly being mounted on said rotor assembly drive shaft extending through said shaft seal;

a fan, incorporated in the upper portion of the outer centrifuge housing in the back thereof which moves a cooling air flow through said opening between said upper and lower portions and moves the cooling air flow onto, across, and around the inner rotor chamber housing, to remove heat therefrom, and exhausts said cooling air flow from the outer centrifuge housing after it has passed by the rotor chamber, whereby heat is removed from the rotor chamber and the cooling air flow is prevented from coming into contact with air within the interior of the rotor chamber, reducing the chance of hazardous materials being introduced into the cooling airflow and thereby into the environment of the outer centrifuge housing.

11. A centrifuge adapted to centrifugation of hazardous materials, comprising:

an outer centrifuge housing defining an exterior surface of the centrifuge and an interior space therein, said outer centrifuge housing having openings therein adapted for admitting air and exhausting air;

a baffle plate incorporated in the interior space of the outer housing separating a first interior portion of the centrifuge from a second interior portion thereof, said baffle plate being positioned with respect to said openings so that at least one of the openings in the outer centrifuge housing opens into said first interior portion on a first side of the baffle plate and at least one of said openings in the outer housing opens into the second interior portion on a second side of the baffle plate, the baffle plate defining at least one opening therethrough from the first interior portion of the centrifuge to the second interior portion of the centrifuge;

an inner rotor chamber housing defining a sealable rotor chamber carried by said outer centrifuge housing and contained within the second interior portion of the centrifuge, the motor chamber being sealed against escape of air therefrom into the interior space of the outer centrifuge housing;

a rotor assembly adapted to hold specimens to be separated by centrifugation disposed within said inner rotor chamber housing and carried by a rotor drive shaft actuated by a rotor drive motor, said rotor drive shaft being sealingly rotatably engaged by said inner rotor chamber housing;

a fan positioned so as to move the air through the at least one opening in the baffle plate between the second interior portion and the first interior portion, and then out through at least one of said openings in the outer centrifuge housing, and which provides a cooling air flow in contact with said inner rotor chamber housing so as to remove heat therefrom in operation of the centrifuge.

12. The centrifuge of claim 11 wherein the baffle plate divides the interior space of the outer centrifuge housing into an upper portion and a lower portion, said first interior portion being the lower portion and said second interior portion being the upper portion, the inner rotor chamber housing being contained within the upper portion.

13. The centrifuge of claim 12 wherein the fan is disposed adjacent said at least one of said openings in the outer centrifuge housing to blow air therethrough.

14. The centrifuge of claim 13 wherein the at least one opening in said baffle plate is disposed at a front end of the interior space of the outer centrifuge housing, and the openings fin the outer housing are disposed in a back end thereof, so that the cooling air flow is drawn through both the upper and lower portions, reversing horizontal directions at the at least one opening in said baffle plate at the front end of the interior space of the outer centrifuge housing and the rotor drive motor depends from said baffle plate.

15. The centrifuge of claim 14 further comprising an opening in said baffle plate adjacent said rotor drive motor allowing a cooling air flow through the rotor drive motor and across said baffle plate.

16. The centrifuge of claim 15 further comprising a rotor chamber lid seal and sealed rotor chamber lid, whereby said rotor chamber may be selectively sealed by closure of the rotor chamber lid.

17. The centrifuge of claim 16 wherein the sealed rotor chamber lid is made of translucent material so that the interior of said rotor chamber is viewable when the rotor chamber is sealed by closure of said lid.

18. The centrifuge of claim 17 wherein the rotor assembly further comprises sample carrier containers having lids which are engageable with the carrier containers by less than a complete revolution of the lids, said carrier containers having pins which interfit with the lids, and the lids having L-shaped channels that interfit with said pins to effect closure.

19. The centrifuge of claim 18 wherein the sample carrier lids are formed of a translucent material so that the interior of the sample carrier containers can be viewed while the lids are on the carrier containers.

* * * * *